US005785203A

United States Patent [19]

Arshinoff et al.

[11] Patent Number: 5,785,203

[45] Date of Patent: Jul. 28, 1998

[54] TAMPER-EVIDENT CONTAINER WITH INTEGRALLY MOLDED HANDLE

[75] Inventors: Stephen H. Arshinoff, Willowdale; Ronald J. Sturk, Brampton, both of Canada

[73] Assignee: Industrial Containers Ltd., Etobicoke, Canada

[21] Appl. No.: 481,374

[22] PCT Filed: Nov. 14, 1994

[86] PCT No.: PCT/CA94/00634

§ 371 Date: Jul. 7, 1995

§ 102(e) Date: Jul. 7, 1995

[87] PCT Pub. No.: WO95/13222

PCT Pub. Date: May 18, 1995

[30] Foreign Application Priority Data

Nov. 11, 1993 [GB] United Kingdom ..... 9323269

[51] Int. Cl.[6] ..... B65D 17/28; B65D 25/28

[52] U.S. Cl. ..... 220/783; 220/266; 220/270; 220/771

[58] Field of Search ..... 220/771, 754, 220/762, 763, 769, 773, 306, 276, 260, 265, 268, 270, 780, 783

[56] References Cited

U.S. PATENT DOCUMENTS

| | | | |
|---|---|---|---|
| 3,730,382 | 5/1973 | Heisler | 220/771 X |
| 3,804,283 | 4/1974 | Frankenberg . | |
| 3,889,732 | 6/1975 | Wilkins | 220/771 |
| 4,024,976 | 5/1977 | Acton | 220/276 X |
| 4,037,748 | 7/1977 | Stubbs, Jr. . | |
| 4,190,175 | 2/1980 | Allen | 220/276 X |
| 4,357,042 | 11/1982 | Gall . | |
| 4,380,304 | 4/1983 | Anderson | 220/771 X |
| 4,821,910 | 4/1989 | Poirier . | |
| 5,027,973 | 7/1991 | Drogos | 220/771 X |

FOREIGN PATENT DOCUMENTS

| | | |
|---|---|---|
| 2025404 | 3/1992 | Canada . |
| 2019225 | 12/1992 | Canada . |
| 2110355 | 6/1972 | France . |
| 9213125 | 12/1992 | Germany . |

*Primary Examiner*—Allan N. Shoap
*Assistant Examiner*—Niki M. Kopsidas
*Attorney, Agent, or Firm*—Fay, Sharpe, Beall, Fagan, Minnich & McKee

[57] ABSTRACT

A container comprising a main body portion having a top rim, at least one side wall and a bottom wall, and having a tamper evident connection with a lid. The tamper evident connection comprising a channel within a skirt projection outwardly from the side wall below the top rim, a gripping portion of the lid for receiving the top rim and thereby securing the lid to the container. The gripping portion having a distal end to be received within the channel, thereby rendering difficult access to the distal end. The skirt having a breakable and removable portion for facilitating access to the distal end of the gripping portion upon breaking the breakable and removable portion.

12 Claims, 5 Drawing Sheets

TAMPER-EVIDENT CONTAINER WITH INTEGRALLY MOLDED HANDLE

FIELD OF THE INVENTION

The present invention relates to containers or pails, and more particularly to containers or pails having a handle integral thereto. The present invention also relates to a tamper-evident and leak-proof container and lid combination.

BACKGROUND OF THE INVENTION

It is well-known to provide containers or pails with a handle for ease of handling and transportation. Similarly, containers made of plastic material, such as polyethylene, are common in the industry because of their strength and light weight compared to containers made of other materials. The handles on these plastic containers generally comprise a suitably configured metal rod or plastic rod disposed at diametrically opposite points near the container's top. The handle is usually pivotally connected to the container to allow it to swing from one side of the container to the other.

The usual way to pivotally connect the handle to the container is by providing a raised element on the outside of the container. On this raised area is a hole through which the ends of the handle are inserted and hooked in place. The ends of the handle are adapted to allow the handle to swing from one side to the other.

The disadvantages of the containers and handles of the prior art are that these two components are manufactured separately. Thus, additional work is required to connect the handle in place on the container. Secondly, it is usual for writing or other printed matter to be printed on the outside of the container. The additional step of connecting the handle to the container cannot usually be done until the printing is completed.

Tamper-evident containers have been described in the art. For example, Canadian Patent No. 2,019,225 issued to IPL Inc. describes a square tamper-evident closure and container combination incorporating means to provide a visual indication of the removal of the closure. The means is a flange peripherally extending from the container having weakened corners such that the flange will break when the closure is removed.

Leak-proof containers and closures are also known in the art. U.S. Pat. No. 4,037,748 issued to Stubbs describes a plastic leak-proof container, but requires the formation of a curl on the rim of the container which is used with a suitable lid to make the container leak-proof.

SUMMARY OF THE INVENTION

According to the present invention, a container is provided in which the handle is integral to the container itself, rather than being manufactured separately and then connected thereto. The portions of the handle near the container are bendable to allow the handle to swing from one side to the other of the container. One or more breakable connections are preferably provided between a central portion of the carrying handle and the container wall for holding the handle in position. Among other advantages, this feature facilitates the process of printing on the container wall. In accordance with a further embodiment of the present invention a tamper-evident and leak-proof container and lid combination is provided.

BRIEF DESCRIPTION OF THE DRAWINGS

The present invention is described in greater detail below with reference to the accompanying drawings in which.

DETAILED DESCRIPTION OF THE PREFERRED EMBODIMENT

Figure 1:
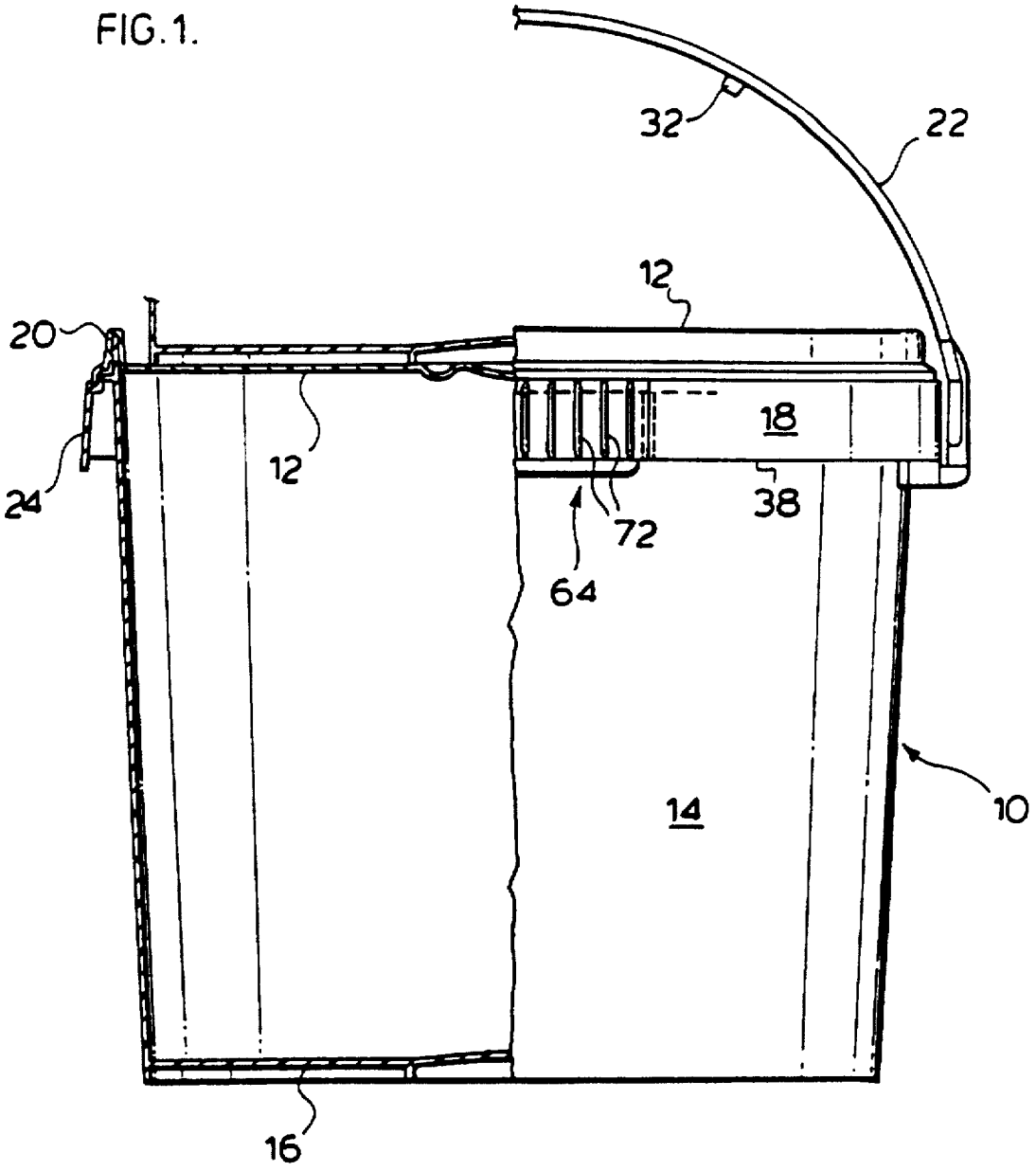
FIG. 1 is a partial cross-sectional view of the container and lid of the present invention.
Figure 2:
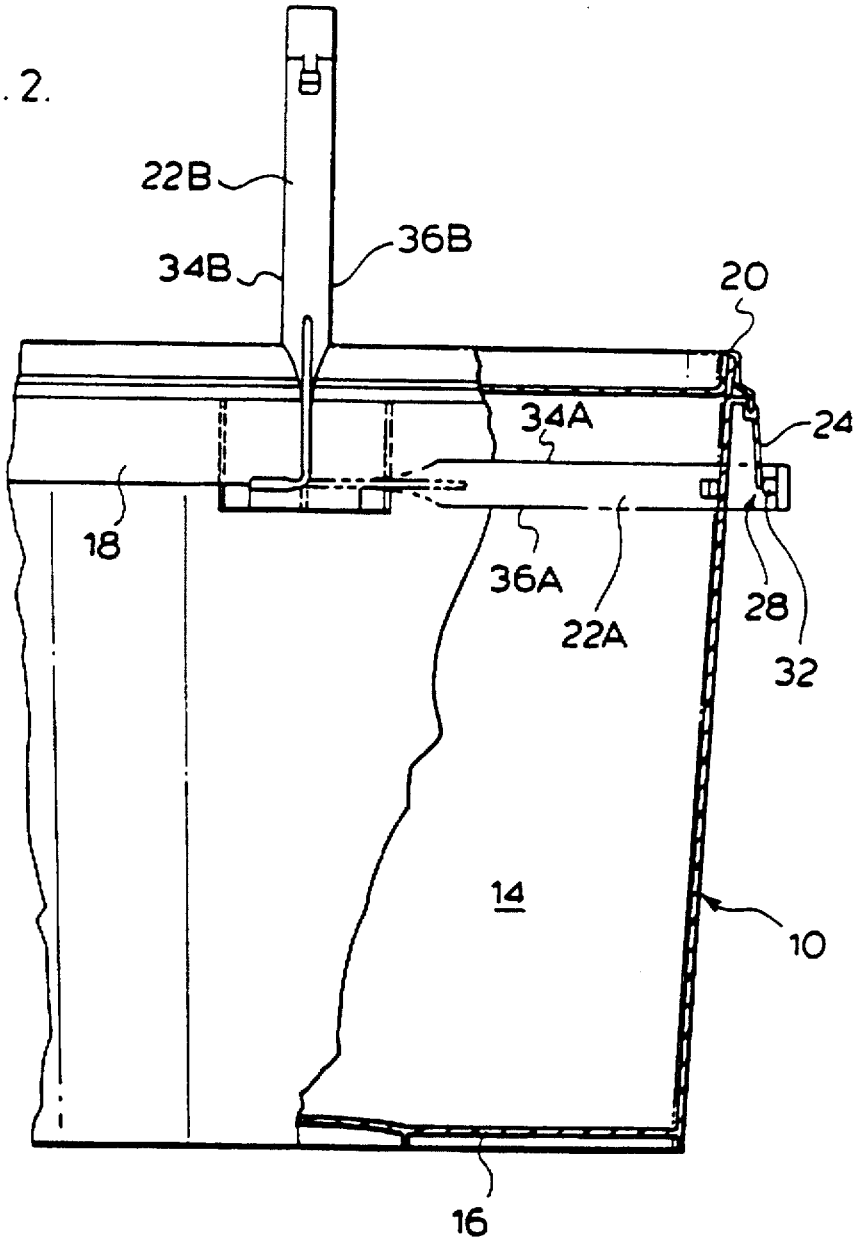
FIG. 2 is a further partial cross-sectional view of the container and lid of the present invention.

Referring to FIGS. 1 and 2, there is shown a container, generally denoted 10, which is adapted to receive a lid 12. Container 10 comprises a generally cylindrical body 14 and bottom wall 16. An annular skirt 18 is connected to cylindrical wall 14 near the top rim 20 of container 10. A handle 22 is connected to skirt 18 at two diametrically opposed points on skirt 18. The connection of handle 22 to skirt 18 is described in greater detail below.

As is well known in the art, container 10 and lid 12 are typically made of polymers such as polyethylene. Any known method of manufacturing container 10 and lid 12 can be used, with the preferable method of manufacture being by injection molding.

Figure 3:
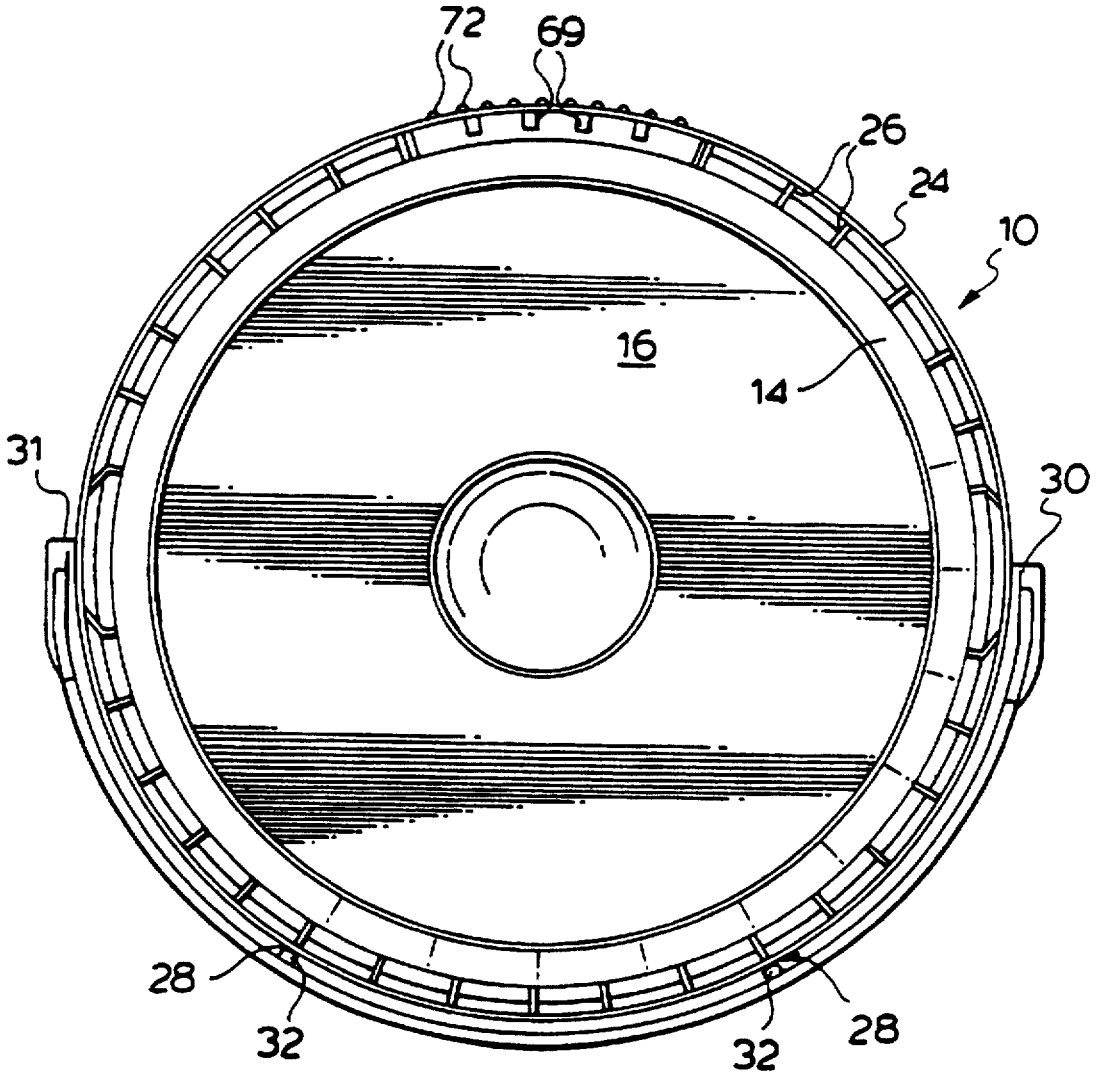
FIG. 3 is a bottom view of the container of the present invention.

Skirt 18 comprises a peripheral, slightly outwardly projecting flange 24. Flange 24 is held in place away from the outside surface of cylindrical wall 14 by means of a plurality of ribs 26 (FIG. 3). The connection of skirt 18 to container 10 is described in further detail below with reference to FIG. 5.

Turning to FIG. 2, the connection of handle 22 to skirt 18 is illustrated. In FIG. 2, handle 22 is shown in two positions: a first horizontal position and a second vertical position. In its first position, handle 22 is denoted with numeral 22A. Handle 22A lies horizontally, substantially parallel with skirt 18. Handle 22A is held in its first position by at least one breakable connection 28 located between flange 24 and the inside surface of boss 32 extending from handle 22A. The breakable connection 28 between the boss 32 and the flange 24 is such that handle 22A is held in place, but the connection is relatively weak so that a user can break the connection and lift the handle to its second position. The connection 28 also facilitates filling of the mold from which the container 10 of the present invention is made with plastic, during injection molding thereof.

In its second position, handle 22 is denoted by numeral 22B, and in FIG. 2 it is shown in a generally vertical position. In its second position, handle 22B can be used to carry container 10 in the usual way. It will be understood that handle 22, once the breakable connection 28 is broken, can swing from one side of container 10 to the other, although as discussed below the handle is biased to one side when the container is not being carried.

Referring to FIG. 3, container 10 is shown in bottom plan view. As can be seen in FIG. 3 (and also in FIG. 1), cylindrical wall 14 is slanted slightly outward starting from bottom wall 16 to its top rim 20. In the preferred embodiment, wall 14 is slanted 3° from vertical. This allows a plurality of containers 10 to be stacked one inside the other. In FIG. 3, the plurality of ribs 26 discussed above, are shown connecting flange 24 to cylindrical wall 14.

In FIG. 3, handle 22 is shown in its first position, namely lying parallel with skirt 18. Handle 22 is flexibly connected to flange 24 of skirt 18 at two diametrically opposed points 30 and 31. In the preferred embodiment of FIG. 3, handle 22 is held in its first position via two holdings points 28. As discussed above, at each of the breakable connections 28, a boss 32 is disposed on the inside surface of handle 22 and the size of boss 32 is such that its end touches flange 24 when handle 22 is in its first position. The easily breakable connection 28 thereby releasably fixes handle 22 in its first position (shown in FIG. 2 as 22A).

Figure 4:
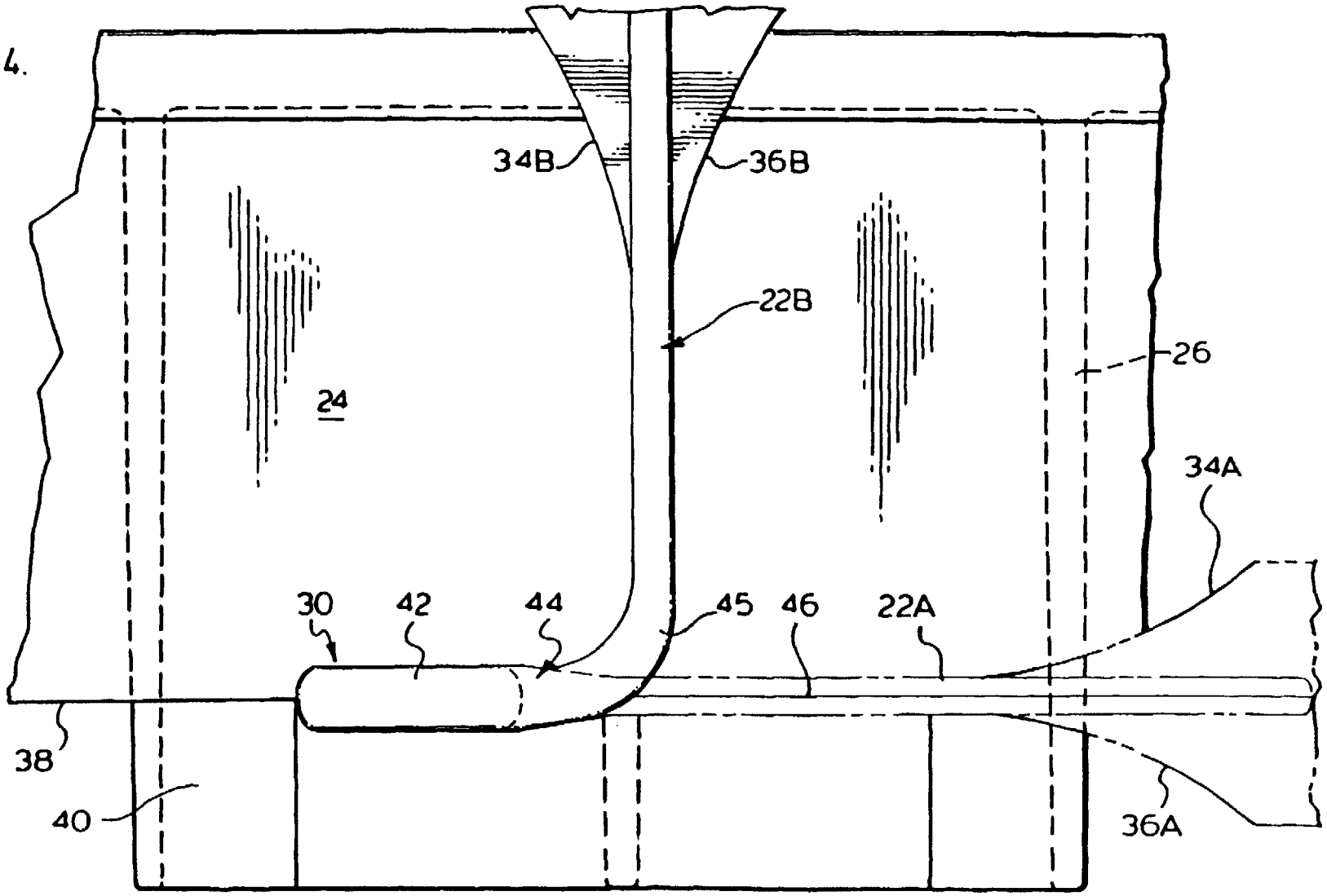
FIG. 4 is a partial detailed view of the connection of the handle to the container.

Referring to FIG. 4, one of the connection points 30 of handle 22 to skirt 18 is shown in greater detail. In FIG. 4, handle 22 is denoted with numeral 22A when in its first, horizontal position and with numeral 22B when the handle is in its second, vertical position.

As seen in FIG. 4 and more generally in FIG. 2, handle 22 has, in the vicinity of connection points 30 and 31, converging outside edges 34 and 36 (shown in FIGS. 2 and 4 as 34A and 36A for the horizontally positioned handle 22A, and 34B and 36B for the vertically positioned handle 22B). In FIG. 2, it will be seen that for most of the length of handle 22, outside edges 34 and 36 are generally parallel to each other. However, in the vicinity of connection points 30 and 31, outside edges 34 and 36 converge towards each other but not to the extent of meeting each other. Rather, handle 22 has a narrow, hinge portion 45 with a bending axis which is perpendicular to container wall 14. This hinge portion 45 is sufficiently narrow width to permit bending of handle 22.

Thus, for most of its length, handle 22 is generally sufficiently wide to prevent bending of handle 22. However, in proximity to connection points 30 and 31, handle 22 becomes sufficiently narrow to permit sideways bending of handle 22 through hinge portion 45 about the connection points 30 and 31. Thus, handle 22 is able to swing from its first, horizontal position, through its second vertical position and over to the other side of container 10.

It will be understood by persons skilled in the art that the construction of handle 22 in proximity to connection points 30 and 31 need not specifically be as illustrated in FIG. 4. That is, outside edges 34 and 36 do not have to converge as shown. Rather, it will be appreciated that the important feature is to have a portion of handle 22 near connection points 30 and 31 that is sufficiently narrow to allow handle 22 to bend so that handle 22 can swing from one side of container 10 to the other. Of course, that portion of handle 22 should not be so narrow as to likely break if container 10 is too heavy.

In the preferred embodiment of container 10 of the present invention, the lower edge 38 of flange 24 is generally straight, as shown in FIG. 1. However, in the area of connection points 30 and 31, flange 24 includes extension portions 40 for each connection point 30 and 31, respectively. In a preferred embodiment of the container of the present invention, extension portions 40 extend a sufficient distance from the container wall 14 to permit de-nesting of the containers when stacked.

Each of connection points 30 and 31 comprise a generally oblong base member 42 integrally connected to flange 24. Extending from the side 44 of base 42 is the hinge portion 45 of handle 22. Thus, handle 22 is integrally connected to base 42, which in turn is integrally connected to extension portion 40 of flange 24.

In the preferred embodiment, the dimensions of extension portion 40, base 42 and hinge portion 45 of handle 22 are such that the center line 46 of handle 22A lies in the same horizontal plane as lower edge 38 of flange 24 when handle 22A is in its first horizontal position. Another feature of the preferred embodiment of the present invention as shown in FIG. 4 is that handle 22 extends from the side 44 of oblong shaped base 42. Thus, the hinge portion 45 of handle 22 is bent when handle 22 is in its second position, whereas the hinge portion 45 is straight when handle 22 is in its first horizontal position so as to bias the handle 22 downwardly away from the top of the container when the container is not being carried, thereby facilitating easy stacking of multiple containers. It will be appreciated by a person skilled in the art that handle 22 need not extend from the side 44 of oblong base 42. Rather handle 22 can extend vertically from the top of base 42 so as to bias the handle toward the second vertical position. Similarly, base 42 need not be oblong but can be U-shaped or any other suitable shape. Preferably, however, handle 22 will extend horizontally from the side 44 of base 42 so that handle 22 is straight when it is in its first, horizontal position.

One advantage to having handle 22 integrally molded with container 10 is that the extra step of connecting the handle to the container as required in the prior art is eliminated. As well, by having handle 22 initially releasably connected to flange 24 in its first, horizontal position, handle 22 is kept away from cylindrical wall 14. This allows printing of written matter on wall 14 without interference from handle 22.

Figure 5:
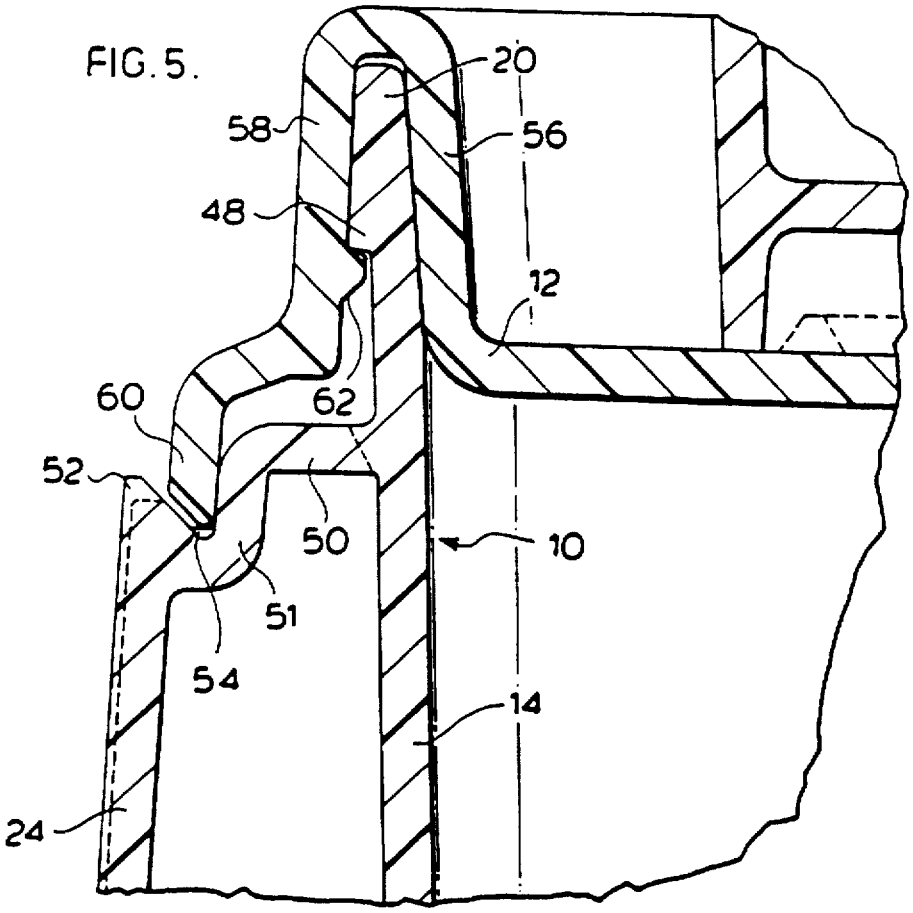
FIG. 5 is a partial cross-sectional view of the container's rim and of the lid.

With reference to FIG. 5, there is shown the closing mechanism of lid 12 and container 10. Cylindrical wall 14 extends from the bottom wall 16 (not shown in FIG. 5) up to its top rim 20. Located near the top rim 20 is a circumferential outwardly extending ridge 48. Disposed below ridge 48 and extending outwardly from cylindrical wall 14 is a generally horizontal ledge 50. Ledge 50 extends outwardly and then curves twice in an "S" fashion, and includes a substantially downwardly extending portion 51. Ledge 50 and downwardly extending portion 51 are connected to flange 24 near the top 52 of flange 24. Top 52 extends beyond the point of connection between the end of ledge 50 and flange 24, thereby defining a circumferential channel 54.

The peripheral edge of lid 12 has an inverted U-shape comprising a first upwardly extending leg 56 and a second downwardly extending leg 58 which terminates at end 60. End 60 is adapted to fit completely within channel 54.

Disposed on the inside surface of leg 58 is a circumferential inward ridge 62. The peripheral edge of lid 12 is adapted to fit tightly over rim 20. When lid 12 is tightly secured over rim 20, inward ridge 62 is located immediately below outward ridge 48. The distance between legs 56 and 58 are such that a tight, snap-on fit is formed around rim 20 such that lid 12 is held securely on container 10. The seal formed between lid 12 and upper rim 20 of cylindrical wall 14 is therefore tight and leak-proof.

The tamper-evident feature of the container 10 and lid 12 combination of the present invention is that the end 60 of downwardly extending leg 58 of lid 12 terminates within the channel 54. End 60 is downwardly and inwardly sloped to provide a tight fit within channel 54. Thus, it is very difficult to access the end 60 and lift it out of channel 54 in order to remove lid 12 from the container 10.

Figure 6:
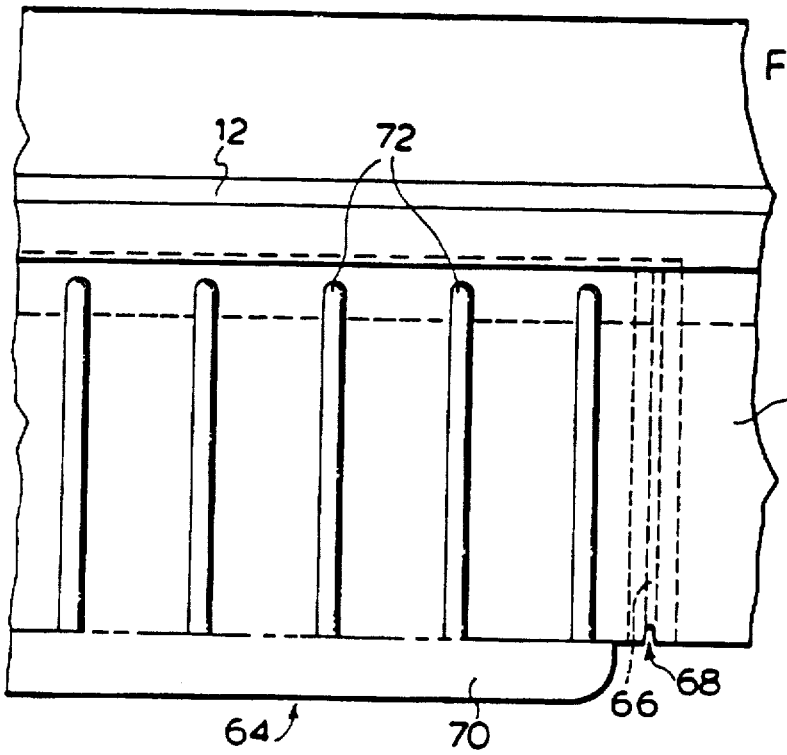
FIG. 6 is a partial view of the tamper evident means according to the present invention.

As illustrated in FIG. 1 and more particularly in FIG. 6, the skirt 18 and flange 24 comprise at least one portion having tear-away means for allowing that portion of flange 24 to be torn away by the user. In FIG. 1, one such tear-away portion is generally denoted with numeral 64. Shown in greater detail in FIG. 6, flange 24 includes tear-away portion 64. The connection point 66 between flange 24 and tear-away portion 64 is weakened to allow tear-away portion 64 to be manually torn off and removed from flange 24 by the user. The tear-away connection point 66 may further include a notch 68 to facilitate the tearing of portion 64 from flange 24. Ribs 69 are located on tear-away portion 64 but are not connected to wall 14, whereas ribs 26 located behind flange 24 are connected to both wall 14 and flange 24.

Tear-away portion 64 may include an extension flap 70 and ridges 72 adapted to allow the user to easily grip tear-away portion 64 in order to tear it away from flange 24. Thus, when the user needs to remove lid 12 from container 10, the user grasps extension portion 70 and tears away tear-away portion 64. This exposes lower end 60 of rim 12 in the area where tear-away portion 64 was located, thereby allowing the user to grasp lower end 60, lift it and remove lid 12 from container 10. Since it is very difficult to remove lid 12 without removing tear-away portion 64, a user can visually determine if the contents of the container 10 have been tampered with merely by determining whether tear-away portion 64 has been removed or not.

Alternatives and modifications to the container and lid of the present invention are possible. For example, the two pivot connection points 30 and 31 between handle 22 and the flange 24 need not be located on extension portions 40, but rather can be located directly on flange 24. Furthermore, tear-away portion 64 need not include extension flap 70. Also, the cross-sectional shape of the main body 14 of container 10 need not be circular, but can be square or other shape, with appropriate modifications to the shape of handle 22. All such modifications are believed to be within the sphere and scope of the present invention as defined in the claims appended hereto.

We claim:

1. A tamper evident container comprising:

a main body having a top rim;

a lid to engage said top rim and seal said container;

a skirt oriented generally downwardly and outwardly about the periphery of said main body adjacent said top rim and having an upturned lip about its periphery to inhibit access to the edge of said lid when said lid is in engagement with said top rim; and at least one tear-away portion on said skirt to expose a portion of said edge upon removal of said tear-away portion from said skirt, said tear-away portion being defined by two spaced apart lines of weakness traversing said skirt.

2. The tamper evident container of claim 1 further including a plurality of spaced apart ribs formed on said main body behind said skirt for supporting said skirt at spaced locations.

3. The tamper evidence container of claim 2 wherein said main body is void of ribs behind said at least one tear-away portion.

4. A tamper evident container comprising:

a generally cylindrical body having a circular base and an upstanding sidewall about the periphery of said base and defining a top rim;

a lid having an annular recess therein sized to receive said rim to seal said container;

a skirt on said body oriented generally downwardly and outwardly about the circumference thereof adjacent said top rim, said skirt having an annular, generally horizontal portion extending outwardly from said main body and a concentric, generally vertical portion depending from a distal end of said horizontal portion, said generally vertical portion extending above said horizontal portion to define a lip to inhibit access to the edge of said lid when said lid engages said top rim; and at least two spaced apart lines of weakness traversing said generally vertical portion to define a tear-away portion on said skirt to provide access to the edge of said lid upon breaking and removal of said tear-away portion from said skirt.

5. A tamper evident container with lid, comprising:

(a) a main body portion of said container having a top rim, at least one side wall and a bottom wall;

(b) channel forming means projecting outwardly from said at least one side wall below said top rim, said channel forming means further comprising a ledge projecting outwardly from said at least one side wall, a generally downwardly and outwardly oriented skirt extending from a distal portion of said ledge, and a channel formed in said ledge;

(c) gripping means on said lid for receiving said top rim and thereby securing said lid to said container, said gripping means having a distal end thereof adapted to be received within said channel forming means thereby rendering difficult access to said distal end; and (d) a breakable and removable portion of said channel forming means for facilitating access to said distal end of said gripping means upon breaking and removal of said breakable and removable portion, said breakable and removable portion being defined by a pair of spaced apart lines of weakness traversing said channel forming means.

6. The tamper evident container with lid of claim 5, wherein said gripping means is generally U-shaped and further comprises a first upwardly extending leg contacting an inside portion of said at least one side wall, a second downwardly extending leg extending from said first leg and terminating in said distal end.

7. The tamper evident container with lid of claim 6, further comprising a ridge extending outwardly from said top rim for providing an undercut portion therebeneath, and an inward ridge extending from said second downwardly extending leg portion adapted to engage said undercut thereby forming a snap-fit connection of said lid to said container.

8. The tamper evident container with lid of claim 7, further including a notch in said skirt coterminous with said lines of weakness to facilitate tearing of said skirt along said lines of weakness.

9. The tamper evident container with lid of claim 8, further comprising an extension flap projecting downwardly from said breakable and removable portion to facilitate gripping said breakable and removable portion.

10. The tamper evident container with lid of claim 8, further including a plurality of ridges projecting outwardly from said breakable and removable portion to facilitate gripping said breakable and removable portion.

11. The tamper evident container with lid of claim 5, further including a plurality of ribs interconnecting said at least one side wall and said skirt, for fixing in place said skirt relative to said at least one side wall.

12. The tamper evident container with lid of claim 5, wherein said distal end tapers downwardly and inwardly relative to said channel.

* * * * *